United States Patent [19]

Wilger et al.

[11] Patent Number: 4,534,135

[45] Date of Patent: Aug. 13, 1985

[54] GRINDING MACHINE FOR WATERTIGHT HATCH LUGS

[75] Inventors: John F. Wilger, Honolulu; Gregory S. Nakano, Pearl City; Stephen Orillo, Jr., Mililani; John R. Cazinha, Kaneohe, all of Hi.

[73] Assignee: The United States of America as represented by the Secretary of the Navy, Washington, D.C.

[21] Appl. No.: 578,722

[22] Filed: Feb. 9, 1984

[51] Int. Cl.[3] ..... B24B 19/00

[52] U.S. Cl. ..... 51/241 S

[58] Field of Search ..... 51/241 R, 241 S, 241 B, 51/245, 241 A

[56] References Cited

U.S. PATENT DOCUMENTS

| | | | |
|---|---|---|---|
| 2,297,074 | 9/1942 | Rohrdanz | 51/241 B |
| 2,736,995 | 9/1953 | Richey | 51/241 B |
| 4,069,624 | 1/1978 | Henry | 51/241 B |
| 4,361,061 | 11/1982 | Pullen | 82/4 R |
| 4,388,782 | 6/1983 | Rodgers | 51/241 A |

*Primary Examiner*—Roscoe V. Parker.

*Attorney, Agent, or Firm*—Robert F. Beers; Ervin F. Johnston; Thomas Glenn Keough

[57] ABSTRACT

A machine is provided for in-situ grinding of tapered lugs on a hatch, such as a hatch aboard a submarine. A base is provided and a device is attached to alternate lugs of the hatch for mounting the base across the hatch opening. An elongated plate is mounted at its center to the base for pivotal movement thereon. The pivotal plate has opposite ends wherein each end is extendable between a pair of alternate lugs, one of the lugs between one of the pair of lugs being a lug to be ground. A device is mounted on the base for oscillating the pivotal plate back and forth between the lugs of each pair of alternate lugs. A grinder is provided, and a device is utilized for mounting the grinder at one end of the pivotal plate for selectively engaging the grinder with or backing the grinder away from the lug to be ground. With this arrangement a lug can be ground by oscillating the pivotal plate and engaging the grinding means with the lug.

7 Claims, 8 Drawing Figures

GRINDING MACHINE FOR WATERTIGHT HATCH LUGS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

One of the items characteristically refurbished on a submarine during its periodic shipyard overhaul are it's circular hatches. These hatches normally contain about twelve tapered lugs around the hatch opening. It is necessary that these lugs be refurbished in order to make precision contact with the locking ring contained in the hatch cover. During refurbishment these tapered lugs must be worked until there is metal to metal blued contact between the lug and the ring in the hatch cover. Because of the wear to the lugs, clad welding is built up on each lug so that the lugs can then be machined to the proper mating surface with the hatch ring. In the past these lugs have been hand ground with a hand held air grinder. This method of repair is very inaccurate and invariably results in uneven and incorrect tapered angles on the lugs. Because of hand grinding mistakes the lugs often have to be recladded for another try at hand grinding. The inaccuracies which result are blended together by lapping with the locking ring. Unfortunately this method changes the machined angle on the locking ring necessitating its removal and its remachining to the correct angle in a machine shop. To lap the lugs by this method requires removal of the locking ring several times for remachining. The lapping procedure requires days of repetitious and tedious hatch closing, lapping by locking the hatch, opening, cleaning the lapping compound away, reapplying the lapping compound, and lapping again by locking the hatch.

SUMMARY OF THE INVENTION

The present invention overcomes the very tedious and time consuming prior art method of refurbishing a hatch cover with all its inaccuracies by providing a machine which can be mounted in the hatch opening for precisely and quickly grinding each tapered lug to the proper angle after the lugs have been built up with a cladding. This insitu machine includes a base with devices attached to alternate lugs of the hatch for mounting the base across the hatch opening. An elongated plate is mounted at its center to the base for pivotal movement thereon. The pivotal plate has opposite ends wherein each end is extendable between a pair of alternate lugs, one of the lugs between one of the pair of lugs being the lug to be ground. A device is mounted on the base for oscillating the pivotal plate back and forth between the lugs of each pair of alternate lugs. A grinder is provided and a device is provided for mounting the grinder at one end of the pivotal plate for selectively engaging the grinder with or backing the grinder away from the lug to be ground. With this arrangemnt the lug can be ground upon oscillating the pivotal plate and engaging the grinding means with the lug to be ground.

OBJECTS OF THE INVENTION

An object of the present invention is to provide a machine for in place grinding of tapered lugs on a circular hatch.

Another object is to provide a very compact machine which can be mounted in place in a circular hatch for very precise grinding of tapered lugs thereon.

A further object is to provide a low cost machine which can be easily mounted by one man within a hatch opening for easy operation by the man to very precisely grind tapered lugs thereon.

These and other objects of the invention will become more readily apparent from the ensuing description and claims when taken with the appended drawings.

DESCRIPTION OF THE PREFERRED EMBODIMENT

Figure 1:
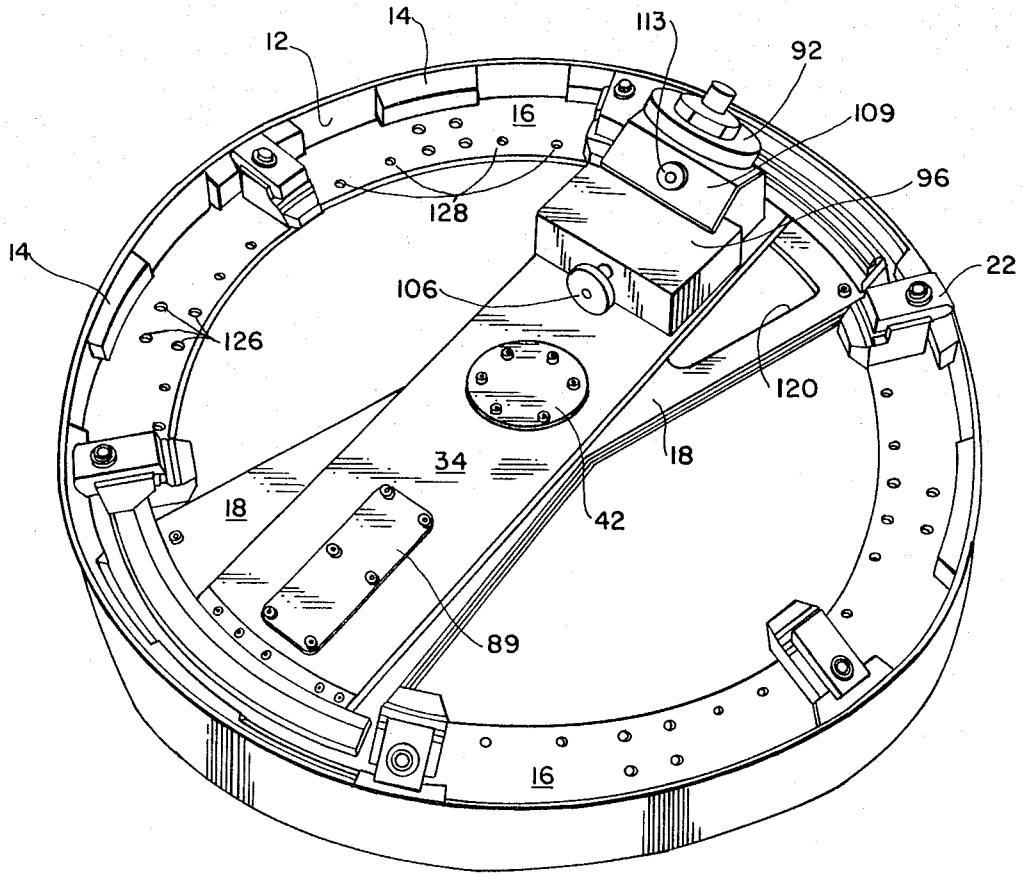
FIG. 1 is a perspective view of the grinding machine mounted in place in a hatch opening for grinding tapered lugs thereon.
Figure 2:
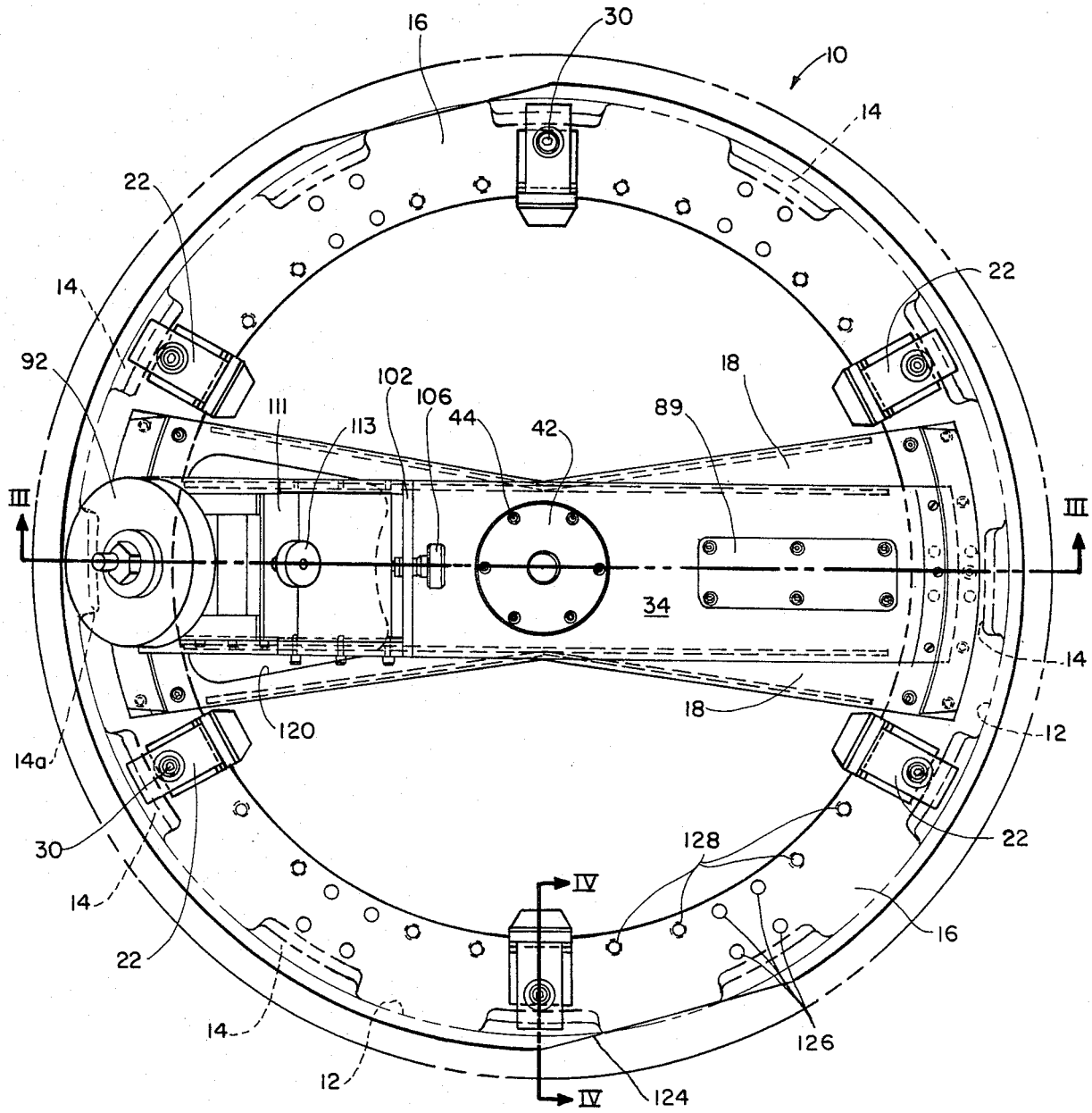
FIG. 2 is a top view of the grinding machine mounted in place in a hatch opening with the hatch opening shown in phantom.
Figure 3:
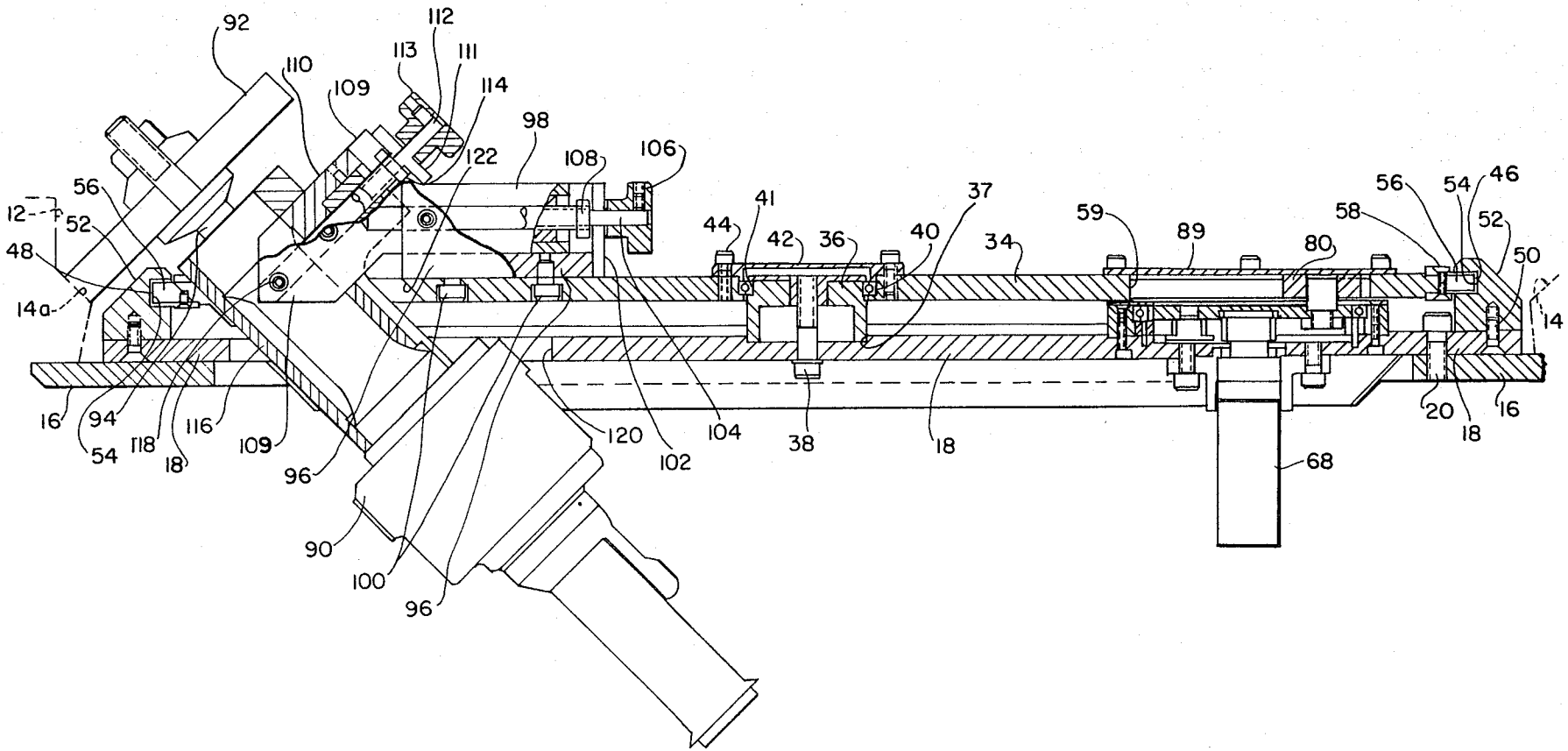
FIG. 3 is a view generally taken along plane III—III of FIG. 2 with portions cut away to show various details thereof.

Referring now to the drawings wherein like reference numerals designate like or similar parts throughout the several views there is illustrated in FIGS. 1, 2 and 3 a machine 10 which can be mounted in place in a circular hatch opening 12 for grinding tapered lugs 14 thereon. Twelve such lugs 14 are shown around the hatch opening in FIG. 2, and each of these lugs must make a very precise blued contact with the ring of a circular hatch cover (not shown). The grinding machine 10 has a base which may include a ring 16 and an elongated support plate 18. The ring 16 extends about the hatch opening and also extends inwardly thereof. The support plate 18 is releasably fixed on the ring 16 and extends thereacross. The support plate 18 may be releasably fixed to the ring 16 by any suitable means such as bolts 20.

Figure 4:
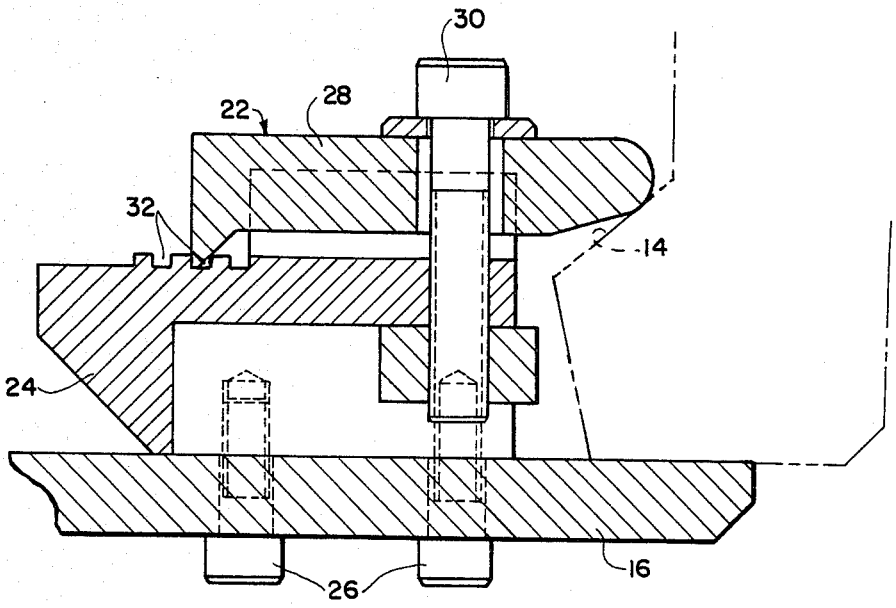
FIG. 4 is an enlarged cross-sectional view taken along plane IV—IV of FIG. 2.

Means are attached to alternate lugs 14 for mounting the ring 16 across the hatch opening. The mounting means include a plurality of clamps 22 which are shown in FIG. 2 and which are shown in cross-section in FIG. 4. The clamp 22 includes an upstanding support 24 which is bolted to the top of the ring 16 by bolts 26. Mounted on top of the support 24 is a bearing element 28 which is secured to the support 24 by a bolt 30, the tightening of the bolt 30 forceably engaging the bearing element 28 with the surface of the respective lug 14. Mating notches 32 are provided between the bearing element 28 and the support 24 for preventing lateral movement therebetween.

Figure 5:
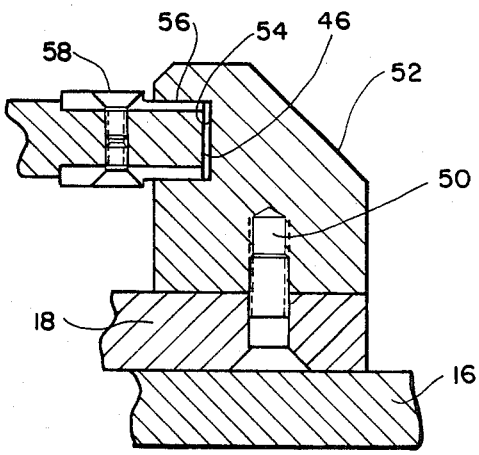
FIG. 5 is an enlarged cross-section of a portion to the right in FIG. 3.

As shown in FIG. 2, another elongated plate 34 is provided, this plate being mounted at its center to the center of the support plate 18 for pivotal movement thereon. The pivotal connection may include an upstanding support 36 which is secured in a central counterbore 37 in the top of the support plate 18 by a bolt 38. The inner race of a bearing 40 may be mounted about the upstanding support 36, and the outer race thereof may be mounted within a counterbore 41 within the top of the pivotal plate 34. A cover plate 42 may be provided over the bearing 40 and secured in place to the top of the pivotal plate 34 by bolts 44. The pivotal plate 34 has opposite ends 46 and 48 wherein each end is extendable between a pair of alternate lugs, as illustrated in FIG. 2, one of the lugs 14 between a pair of lugs being the lug to be ground. Mounted on the support plate 18 by any suitable means, such as bolts 50, are a pair of arcuate bearings 52 which are in opposite positions with respect to one another. Each of the bearings 52 has an arcuate slot 54 for receiving a respective end of the pivoted plate 34. Each end of the pivoted plate 34 may be provided with an arcuate teflon shoe 56 which is secured in place by bolts 58. Accordingly, the opposite ends of the pivoted plate 34 will easily slide back and forth within the arcuate bearings 52. An enlarged detail of these components is shown in FIG. 5.

Figure 6:
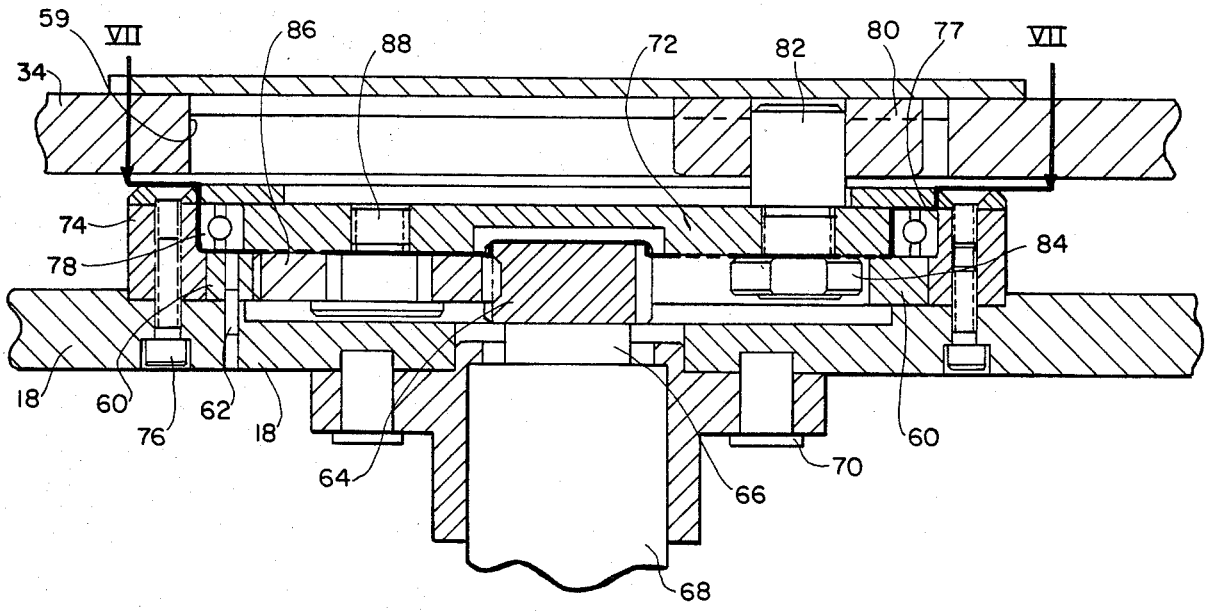
FIG. 6 is an enlarged cross-section of a portion to the right in FIG. 3 with the slide shown out of place so as to illustrate its detail.
Figure 7:
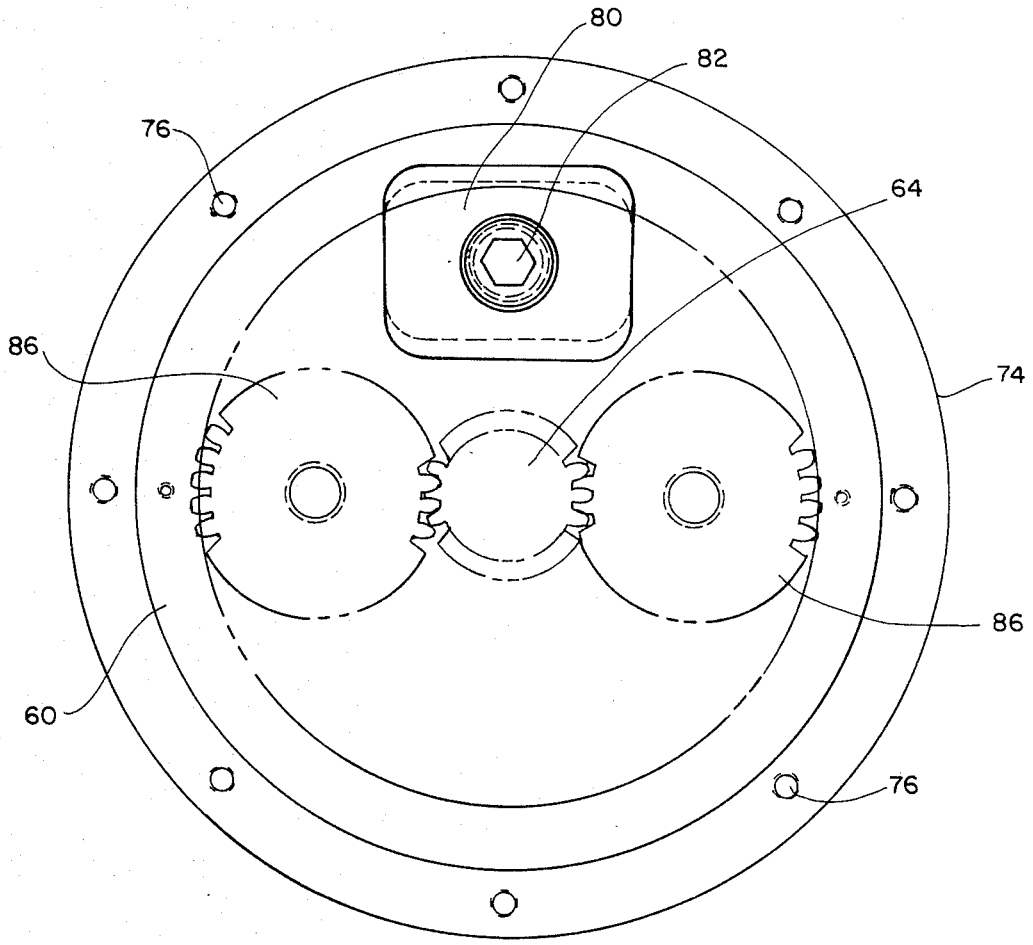
FIG. 7 is a top view taken along plane VII—VII of FIG. 6 with the planetary gears and slide shown in the proper locations.

Means are mounted on the support plate 18 for oscillating the pivoted plate 34 back and forth between the lugs of each pair of alternate lugs 14, such as the pair of lugs on each side of the lug 14*a* to be ground. The oscillating means may include the pivoted plate 34 having a slot 59 as illustrated in FIG. 6. A ring gear 60 is mounted on the support plate 18 by any suitable means such as pins 62, this ring gear being substantially parallel to the pivoted plate 34 and substantially opposite the slot 59. A drive gear 64 is rotatably mounted on the support plate 18 in the center of the ring gear 60. The drive gear may be fixed to an output shaft 66 of an air motor 68, which is in turn secured to the bottom of the support plate 18 by an suitable means suchs as bolts 70. A circular plate 72 may be rotatably mounted on the support plate 18. The means for enabling this rotation may include a ring 74 which is fixed to the top of the support plate 18 by bolts 76, the ring 74 having a counterbore 77 for receiving the outer race of a bearing 78. The inner race of the bearing 78 may be mounted about the circular plate 72. With this arrangement the circular plate 72 will freely rotate above the support plate 18. A slide block 80 may be mounted on the rotatable plate 72 by any suitable means such as a pin and nut arrangement 82 and 84 respectively with the slide block 80 being disposed in the slot 59 of the pivoted plate 34. A pair of planetary gears 86 are rotatably mounted on the rotatable plate 72 by any suitable means such as gear pins 88 which are threaded into the rotatable plate 72. Each planetary gear 86 meshes with the drive gear 64 and the interior teeth of the ring gear 60. With this arrangement rotation of the drive gear 64 will cause the slide block 80 to rotate in the slot 59 so as to oscillate the pivoted plate 34. A cover 89 may be bolted to the pivoted plate over the slot 59 to protect the gears.

Figure 8:
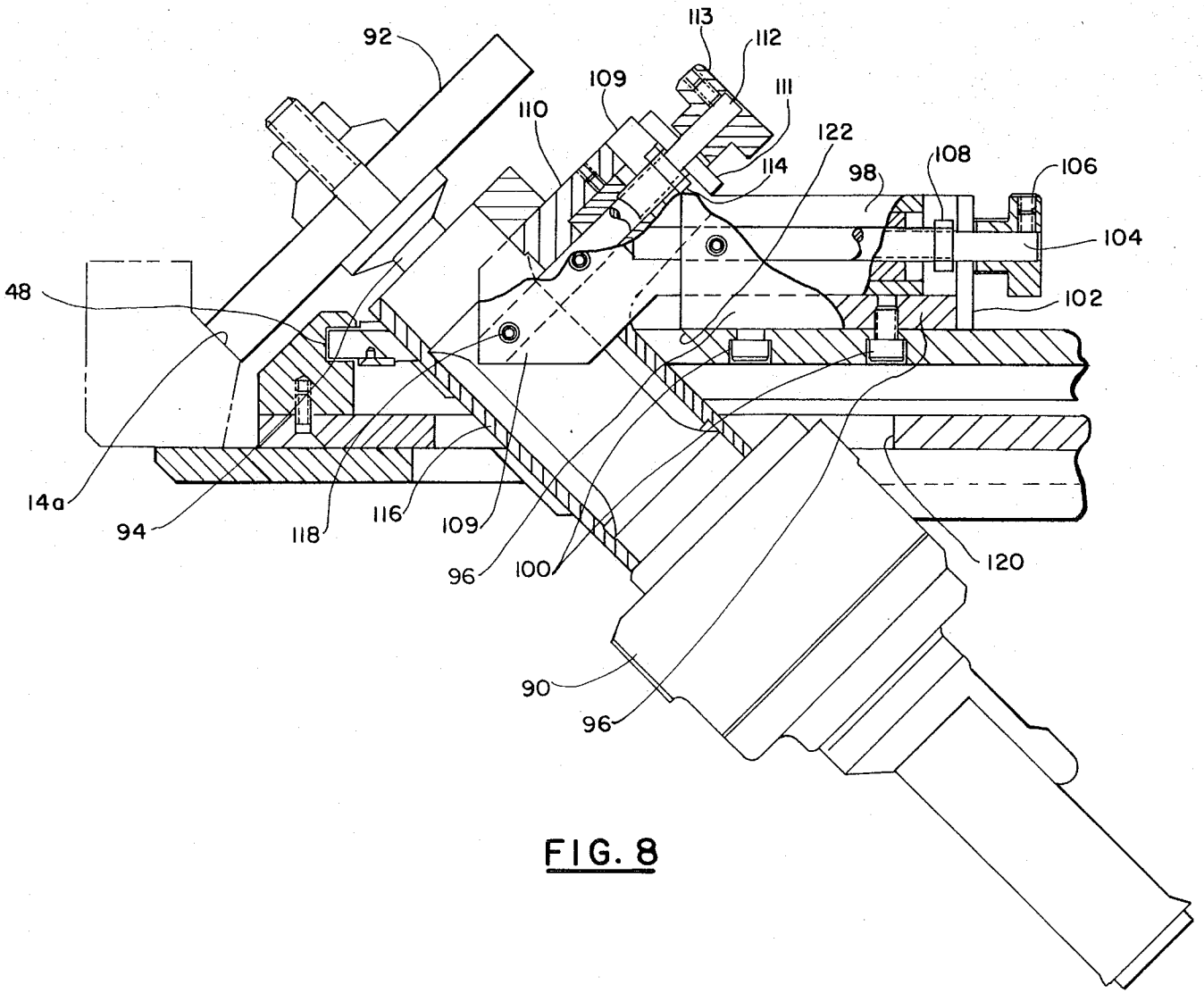
FIG. 8 is an enlarged portion of the left side of FIG. 3.

Means are provided for grinding the lug 14*a*. Such means may include an air motor 90 with a grinding wheel 92 attached to the motors output shaft 94. Means may be provided for mounting the grinding means at one end of the pivoted plate 34 for selectively engaging the grinding wheel 92 or backing the grinding wheel 92 away from the lug 14*a* to be ground. As illustrated in FIGS. 3 and 8, the mounting means for the grinding means may include a bearing 96 and a slide 98 mounted therein, the bearing and slide in turn being mounted on the pivoted plate 34 by any suitable means such as bolts 100. Means are provided for selectively moving the slide 98 toward and away from the lug 14*a* to be ground. This means may include a thrust plate 102 with a shaft 104 extending therethrough, the thrust plate being connected to the end of the bearing 96 by any suitable means such as tac welding. A knob 106 may be connected to the outside end of the shaft 104 and the inner end of the shaft 104 may be threaded within the slide 98, the shaft 104 being retained in its movement by the knob 106 and a collar 108 on opposite sides of the thrust plate 102. A second bearing 109 and slide 110 may be mounted on the first mentioned bearing 98, the mounting of which may be implemented by making the bearings 98 and 109 integral with respect to one another. A similar means is provided for selectively moving the slide 110 in the bearing 109 in a direction perpendicular to the face of the lug 14*a* to be ground. The selective moving means may include a thrust plate 111 through which there extends a shaft 112, the outside of the shaft being connected to a knob 113 and the inside end of the shaft being threaded into the slide 110. The knob 113 and a collar 114 on opposite sides of the thrust plate 111 retain the shaft axially so that desired movement of the slide 110 can be implemented. An elongated bracket 116 is fixed perpendicularly to the bearing 110 by any suitable means such as bolts 118. The bracket 116 holds the motor 90 so that the axis of the grinding wheel 92 is parallel to the face of the lug 14*a* to be ground. The support plate 16 and the pivoted plate 34 are provided with respective apertures 120 and 122. With this arrangement the air motor and bracket can extend through the ring 16, thence through the aperture 120 in the support plate 18, and thence through the aperture 122 in the pivoted plate 34.

It should be noted that the mounting of the motor 90 with its extension through the ring 16 and the apertures 120 and 122 of the plates 18 and 34 facilitate a mounting of the machine 10 in the hatch opening 12. To further facilitate the mounting of the machine the ring 16 is provided with diametrically opposed flat portions 124 (see FIG. 2) which give a smaller cross dimension to the ring at that location than the cross dimension of the hatch opening. With this arrangement the ring can be easily inserted into the hatch opening and secured in place by the lug clamps 22. From FIG. 2 it should be noted that the ring 16 has groups of four of apertures 126 for receiving the bolts 26 to hold the clamping means 22 in place. Also, the ring 16 is provided with groups of four of apertures 128 with pairs of apertures of each group being on opposite sides of the apertures 126. The apertures 128 are utilized for the bolts 50 secure the arcuate bearings 52 in place at selected locations about the hatch opening.

OPERATION OF THE INVENTION

In the operation of the invention the ring 16 is first installed in the hatch opening 12 by placing it through the hatch opening by its smaller dimension across the flatened portions 124. The ring 16 is centrally positioned and the brackets 22 are put in place on alternate lugs 14 so that the ring 16 is secured within the hatch opening. The remainder of the machine is then mounted on the ring 16 by the bolts 20. Prior thereto the acruate bearings 52 are already secured in place on the support plate 18 by bolts 50. With such an arrangement the support plate 18 and the pivoted plate 34 will be disposed between pairs of clamps 22 as illustrated in FIG. 2. This sets the machine up to grind one lug, namely lug 14*a* in the mounting arrangement shown in FIG. 2. The air motors 90 and 68 are started with the grinding wheel 92 spaced from the lug 14*a*. After commencement of operation of the motors 90 and 68 the knobs 106 and 113 are selectively rotated so as to bring the grinding wheel 92 into engagement with the lug 14*a*. Normally all lugs have been previously built up with cladding so that they can be reshaped to their desired configuration. Accurate positioning of the grinding wheel 92 by the knobs 106 and 113 result in precise grinding of the lugs so that they will mate with the ring (not shown) of the hatch cover so as to effect blued contact therebetween. Once the lug 14*a* has been properly ground the bolts 20 are removed to reposition the support plate 18 and the pivoted plate 34 between another pair of lugs 14 and corresponding clamps 22. This procedure is repeated until six lugs are ground. The clamps 22 are then repositioned to the already ground lugs so as to enable grinding of the remaining six lugs.

Obviously, many modifications and variations of the present invention are possible in the light of the above teachings. It is therefore to be understood that within the scope of the appended claims the invention may be practiced otherwise than as specifically described.

What is claimed is:

1. A machine for insitu grinding tapered lugs on a hatch comprising:

a base;

means attached to alternate lugs for mounting the base across the hatch opening;

an elongated plate mounted at its center to the base for pivotal movement thereon;

the pivotal plate having opposite ends, each end of the pivotal plate being extendable between a pair of alternate lugs, one of the lugs between one of said pair of lugs being the lug to be ground;

means mounted on the base for oscillating the pivotal plate back and forth between the lugs of each pair of alternate lugs;

means for grinding;

means mounting the grinding means at one end of the pivotal plate for selectively engaging the grinder with or backing the grinder away from the lug to be ground;

whereby upon oscillating the pivotal plate and engaging the grinding means with the lug to be ground said lug can be ground.

2. A grinding machine as claimed in claim 1 wherein the oscillating means includes:

the pivotal plate having a slot;

a ring gear fixedly mounted on the base substantially parallel to the pivotal plate and opposite said slot;

a drive gear rotatably mounted on the base in the center of the ring gear;

a plate rotatably mounted on the base between the ring gear and the pivotal plate;

a slide block mounted on the rotatable plate and extending into the slot of the pivotal plate; and planetary gears rotatably mounted on the rotatable plate with each planetary gear meshing with the drive gear and the ring gear, whereby upon rotation of the drive gear the slide block rotates in the slot to oscillate the pivotal plate.

3. A grinding machine as claimed in claim 1 including:

a pair of arcuate bearings mounted on the base in opposite opposed positions with respect to one another; and the oscillating means having opposite arcuate ends with each end being slidably mounted in a respective arcuate bearing.

4. A grinding machine as claimed in claim 1 including:

the base including:

a ring extending about the hatch and extending inwardly thereof; and an elongated support plate releasably mounted on the inward extension of the ring and extending thereacross;

the pivotal plate being pivotally mounted on the support plate and the oscillating means being mounted on the support plate;

the base mounting means including a plurality of clamps, each clamp being threaded through the ring and bearing against a respective lug, whereby the ring can first be mounted to the hatch and then the support plate with the pivotal plate and the oscillating means can be mounted to the ring.

5. A grinding machine as claimed in claim 4 including:

the grinding means including a motor with a grinding wheel fixed to the motor shaft;

the mounting means for the grinding means including:

a bearing and slide mounted on the pivotal plate with means for selectively moving the slide toward and away from the lug to be ground;

a second bearing and slide mounted on the first mentioned bearing with means for selectively moving the slide perpendicular to the face of the lug to be ground; and an elongated holder fixed perpendicularly to the second bearing and holding the motor so that the axis of the grinding wheel is parallel to the face of the lug to be ground;

the pivotal plate and the support plate each having an aperture; and the motor extending through the ring and the apertures in the pivotal and support plates.

6. A grinding machine as claimed in claim 5 including:

the pivotal plate having a slot;

a ring gear fixedly mounted on the base substantially parallel to the pivotal plate and opposite said slot;

a drive gear rotatably mounted on the base in the center of the ring gear;

a plate rotatably mounted on the base between the ring gear and the pivotal plate;

a slide block mounted on the rotatable plate and extending into the slot of the pivotal plate; and planetary gears rotatably mounted on the rotatable plate with each planetary gear meshing with the drive gear and the ring gear, whereby upon rotation of the drive gear the slide block rotates in the slot to oscillate the pivotal plate.

7. A grinding machine as claimed in claim 6 including:

a pair of arcuate bearings mounted on the base in opposite opposed positions with respect to one another; and the oscillating means having opposite arcuate ends with each end being slidably mounted in a respective arcuate bearing.

* * * * *